US010533464B2

(12) United States Patent
Son et al.

(10) Patent No.: US 10,533,464 B2
(45) Date of Patent: Jan. 14, 2020

(54) VALVE DURATION CONTROL APPARATUS AND ENGINE PROVIDED WITH THE SAME

(71) Applicant: Hyundai Motor Company, Seoul (KR)

(72) Inventors: You Sang Son, Suwon-si (KR); Kyoung Pyo Ha, Seongnam-si (KR); Back Sik Kim, Osan-si (KR)

(73) Assignee: Hyundai Motor Company, Seoul (KR)

( * ) Notice: Subject to any disclaimer, the term of this patent is extended or adjusted under 35 U.S.C. 154(b) by 1094 days.

(21) Appl. No.: 14/942,900

(22) Filed: Nov. 16, 2015

(65) Prior Publication Data

US 2017/0009613 A1 Jan. 12, 2017

(30) Foreign Application Priority Data

Jul. 7, 2015 (KR) ..... 10-2015-0096266

(51) Int. Cl.
*F01L 1/356* (2006.01)

(52) U.S. Cl.
CPC ..... *F01L 1/356* (2013.01)

(58) Field of Classification Search
CPC ..... F01L 1/356; F01L 2001/0476; F01L 2001/0537; F01L 2820/032
USPC ..... 123/90.15, 90.16
See application file for complete search history.

(56) References Cited

U.S. PATENT DOCUMENTS

| | | | |
|---|---|---|---|
| 5,365,896 | A | 11/1994 | Hara et al. |
| 5,924,334 | A | 7/1999 | Hara et al. |
| 8,813,704 | B2 | 8/2014 | Kim et al. |
| 9,512,748 | B2 | 12/2016 | Kim et al. |
| 2013/0146006 | A1 | 6/2013 | Kim et al. |

FOREIGN PATENT DOCUMENTS

| | | | |
|---|---|---|---|
| CN | 102477879 | A | 5/2012 |
| CN | 102667078 | A | 9/2012 |
| CN | 102852581 | A | 1/2013 |
| CN | 103201465 | A | 7/2013 |
| CN | 103306776 | A | 9/2013 |
| CN | 104040121 | A | 9/2014 |
| CN | 103201465 | B | 7/2015 |
| DE | 19825307 | A1 | 12/1999 |
| JP | 6-185321 | A | 7/1994 |

(Continued)

OTHER PUBLICATIONS

U.S. Appl. No. 14/942,250, filed Nov. 16, 2015.
U.S. Appl. No. 14/942,671, filed Nov. 16, 2015.
U.S. Appl. No. 14/948,294, filed Nov. 21, 2015.

*Primary Examiner* — Mark A Laurenzi
*Assistant Examiner* — Paul W Thiede
(74) *Attorney, Agent, or Firm* — Morgan, Lewis & Bockius LLP

(57) ABSTRACT

A continuously variable valve duration apparatus may include a camshaft, a plurality of first cams and second cams of which a cam key is formed respectively thereto, and of which relative phase angles with respect to the camshaft are variable, a plurality of rotation rings mounted to the camshaft and of which a ring key is formed thereto respectively, a plurality of inner brackets transmitting rotation of the camshaft to the cam keys of the first cams and the seconds respectively, a plurality of slider housings of which each inner bracket is rotatable inserted therein, a support bracket connecting the slider housings and a control portion selectively moving the support bracket and moving positions of the slider housings so as to change rotation centers of the inner brackets.

20 Claims, 10 Drawing Sheets

(56) References Cited

FOREIGN PATENT DOCUMENTS

| | | | |
|---|---|---|---|
| JP | 9-41924 | A | 2/1997 |
| JP | 2009-236010 | A | 10/2009 |
| JP | 5582195 | B2 | 7/2014 |

VALVE DURATION CONTROL APPARATUS AND ENGINE PROVIDED WITH THE SAME

CROSS-REFERENCE TO RELATED APPLICATION

The present application claims priority to and the benefit of Korean Patent Application No. 10-2015-0096266 filed on Jul. 7, 2015, the entire contents of which is incorporated herein for all purposes by this reference.

BACKGROUND OF THE INVENTION

Field of the Invention

The present invention relates to a continuous variable valve duration apparatus and an engine provided with the same. More particularly, the present invention relates to a continuous variable valve duration apparatus an engine provided with the same which may vary opening duration of a valve according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directly providing a continuous variable valve duration apparatus and an engine provided with the same which may vary opening duration of a valve according to operation conditions of an engine, with a simple construction.

According to various aspects of the present invention, a continuously variable valve duration apparatus may include a camshaft, a plurality of first cams and second cams of which a cam key is formed respectively thereto, and of which relative phase angles with respect to the camshaft are variable, a plurality of rotation rings mounted to the camshaft and of which a ring key is formed thereto respectively, a plurality of inner brackets transmitting rotation of the camshaft to the cam keys of the first cams and the seconds respectively, a plurality of slider housings of which each inner bracket is rotatable inserted therein, a support bracket connecting the slider housings and a control portion selectively moving the support bracket and moving positions of the slider housings so as to change rotation centers of the inner brackets.

The continuously variable valve duration apparatus may further include a first pin of which a ring key slot where the ring key is slidably inserted thereto is formed thereto and a second pin of which a cam key slot where the cam key is slidably inserted thereto is formed thereto and wherein a first and a second sliding pin holes where the first pin and the second pin are inserted thereto respectively may be formed to the inner brackets respectively.

The first pin and the second pin may be formed as a circular cylinder shape and the first sliding pin hole and the second sliding pin hole may be formed for the first pin and the second pin to be rotated within thereto.

Parts of the first sliding pin hole and the second sliding pin hole may be opened for movements of the ring key and the cam key not to be interrupted.

The continuously variable valve duration apparatus may further include a bearing inserted between the slider housing and the inner bracket.

The continuously variable valve duration apparatus may further include a guider mounted to a cylinder head of which a guide hole is formed thereto, and wherein a guide protrusion may be formed to the slider housing, the guide protrusion may be inserted into the guide hole and the guide hole may guide movements of the guide protrusion.

The control portion may include a ball screw engaged with the support bracket and a control motor selectively rotating the ball screw.

The continuously variable valve duration apparatus may further include a screw bearing mounted to the support bracket for rotatably supporting the ball screw.

The camshaft and the rotation ring may be connected through a connecting pin.

The continuously variable valve duration apparatus may further include a spacer disposed to the camshaft for maintaining distances between one cylinder and neighboring cylinder.

According to various aspects of the present invention, an engine may include a camshaft, a plurality of first cams and second cams of which a cam key is formed respectively thereto, of which relative phase angles with respect to the camshaft are variable, and disposed on a corresponding cylinder respectively, a plurality of rotation rings mounted to the camshaft, of which a ring key is formed thereto respectively, and disposed on the corresponding cylinder respectively, a plurality of inner brackets transmitting rotation of the camshaft to the cam keys of the first cams and the seconds respectively, a plurality of slider housings of which each inner bracket is rotatable inserted therein, a support bracket connecting the slider housings and a control portion selectively moving the support bracket and moving positions of the slider housings so as to change rotation centers of the inner brackets.

The engine may further include a first pin of which a ring key slot where the ring key is slidably inserted thereto is formed thereto and a second pin of which a cam key slot where the cam key is slidably inserted thereto is formed thereto and wherein a first and a second sliding pin holes where the first pin and the second pin are inserted thereto respectively may be formed to the inner brackets respectively.

The first pin and the second pin may be formed as a circular cylinder shape and the first sliding pin hole and the second sliding pin hole may be formed for the first pin and the second pin to be rotated within thereto.

Parts of the first sliding pin hole and the second sliding pin hole may be opened for movements of the ring key and the cam key not to be interrupted.

The engine may further include a bearing inserted between the slider housing and the inner bracket.

The engine may further include a guider mounted to a cylinder head of which a guide hole is formed thereto, and wherein a guide protrusion may be formed to the slider housing, the guide protrusion may be inserted into the guide hole and the guide hole may guide movements of the guide protrusion.

The control portion may include a ball screw engaged with the support bracket and a control motor selectively rotating the ball screw.

The engine may further include a screw bearing mounted to the support bracket for rotatably supporting the ball screw.

The camshaft and the rotation ring may be connected through a connecting pin.

The engine may further include a spacer disposed to the camshaft for maintaining distances between one cylinder and neighboring cylinder.

As described above, a continuous variable valve duration apparatus according to an exemplary embodiment of the present invention may vary an opening duration of a valve according to operation conditions of an engine, with a simple construction.

The continuous variable valve duration apparatus according to an exemplary embodiment of the present invention may be reduced in size and thus the entire height of a valve train may be reduced.

Since the continuous variable valve duration apparatus may be applied to an existing engine without excessive modification, thus productivity may be enhance and production cost may be reduced.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
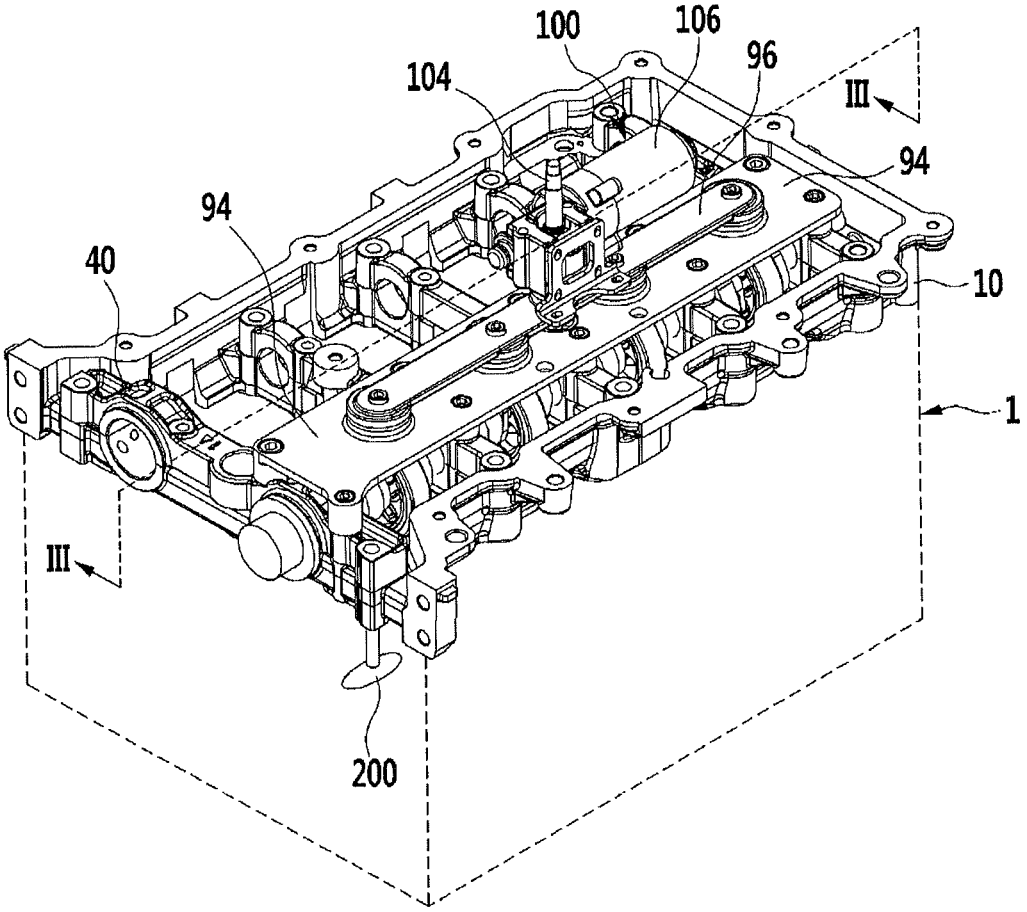
FIG. 1 is a perspective view of an engine provided with a continuous variable valve duration apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention A part irrelevant to the description will be omitted to clearly describe the present invention, and the same or similar elements will be designated by the same reference numerals throughout the specification.

In the drawings, the thickness of layers, films, panels, regions, etc., are exaggerated for clarity.

Throughout the specification and the claims, unless explicitly described to the contrary, the word "comprise" and variations such as "comprises" or "comprising", will be understood to imply the inclusion of stated elements but not the exclusion of any other elements.

An exemplary embodiment of the present invention will hereinafter be described in detail with reference to the accompanying drawings.

Figure 2:
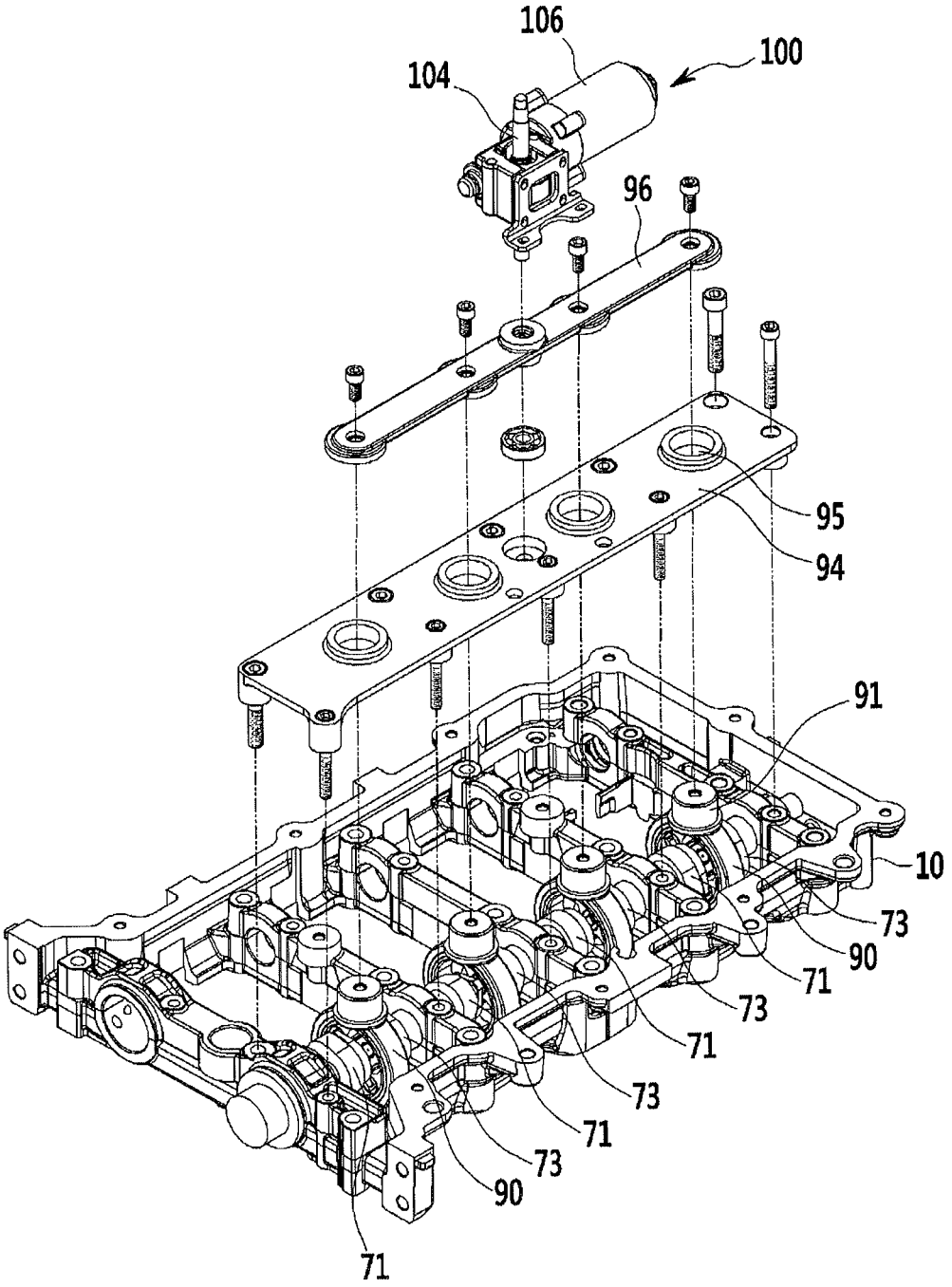
FIG. 2 is a partial exploded perspective view of an engine provided with a continuous variable valve duration apparatus according to an exemplary embodiment of the present invention.
Figure 3:
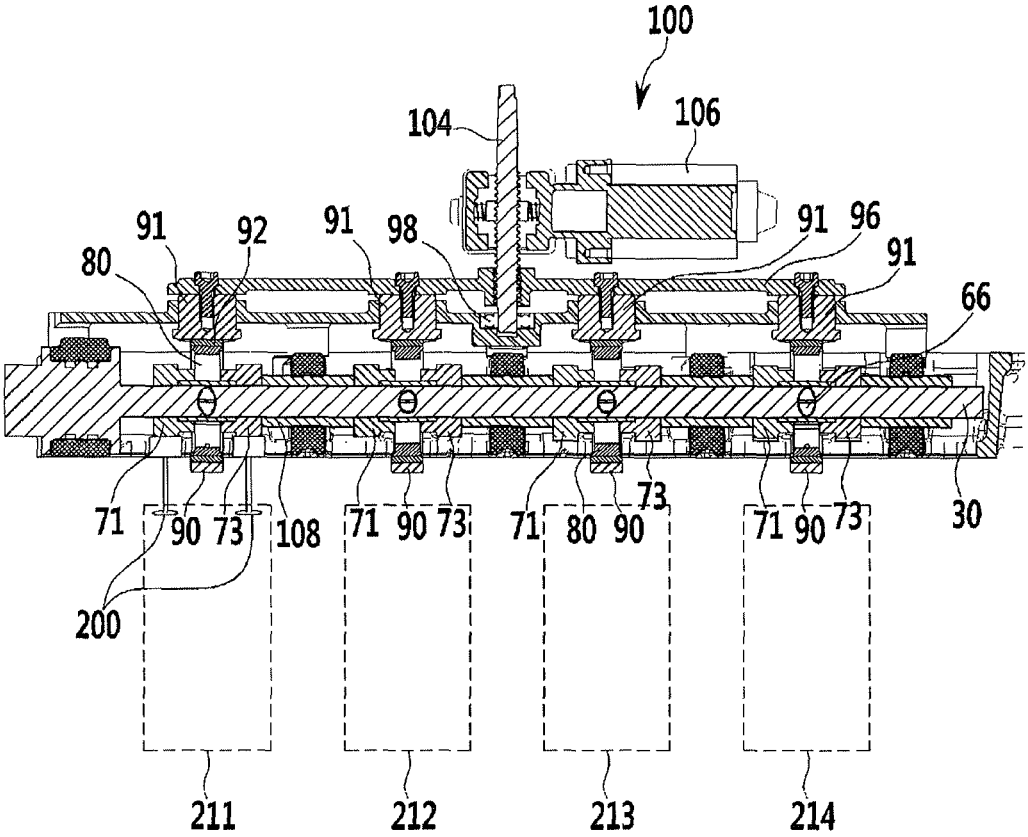
FIG. 3 is a cross-sectional view along line III-III of FIG. 1.

FIG. 1 is a perspective view of an engine provided with a continuous variable valve duration apparatus according to an exemplary embodiment of the present invention, FIG. 2 is a partial exploded perspective view of an engine provided with a continuous variable valve duration apparatus according to an exemplary embodiment of the present invention and FIG. 3 is a cross-sectional view along line III-III of FIG. 1.

Figure 4:
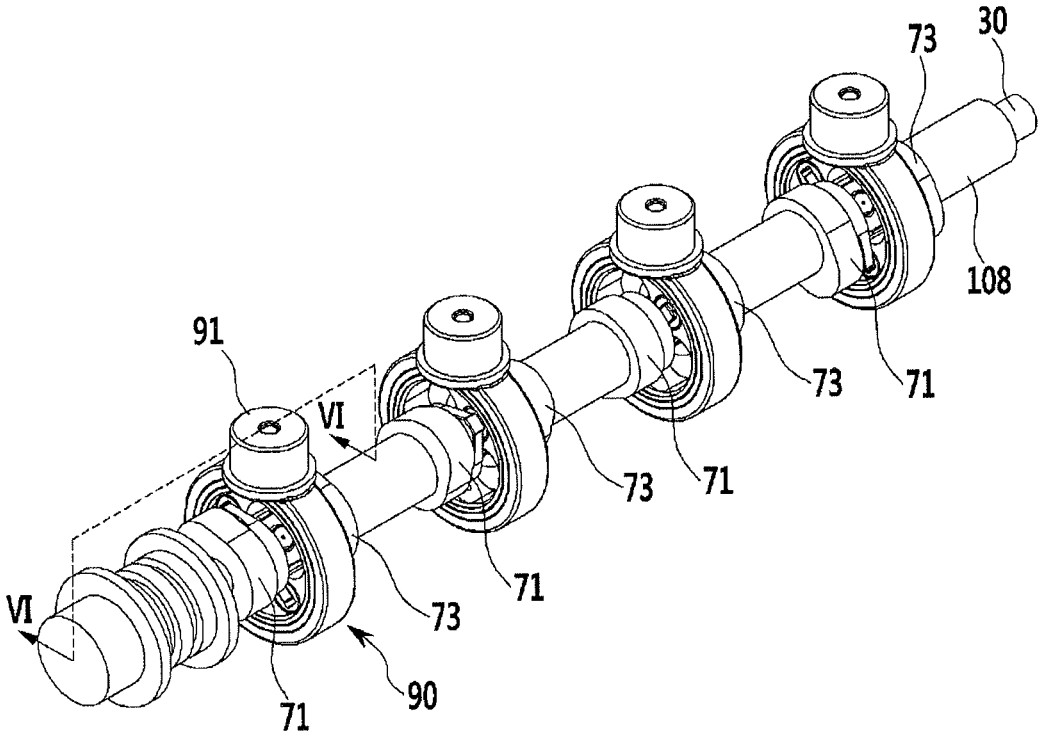
FIG. 4 is a partial perspective view of a continuous variable valve duration apparatus according to an exemplary embodiment of the present invention.
Figure 5:
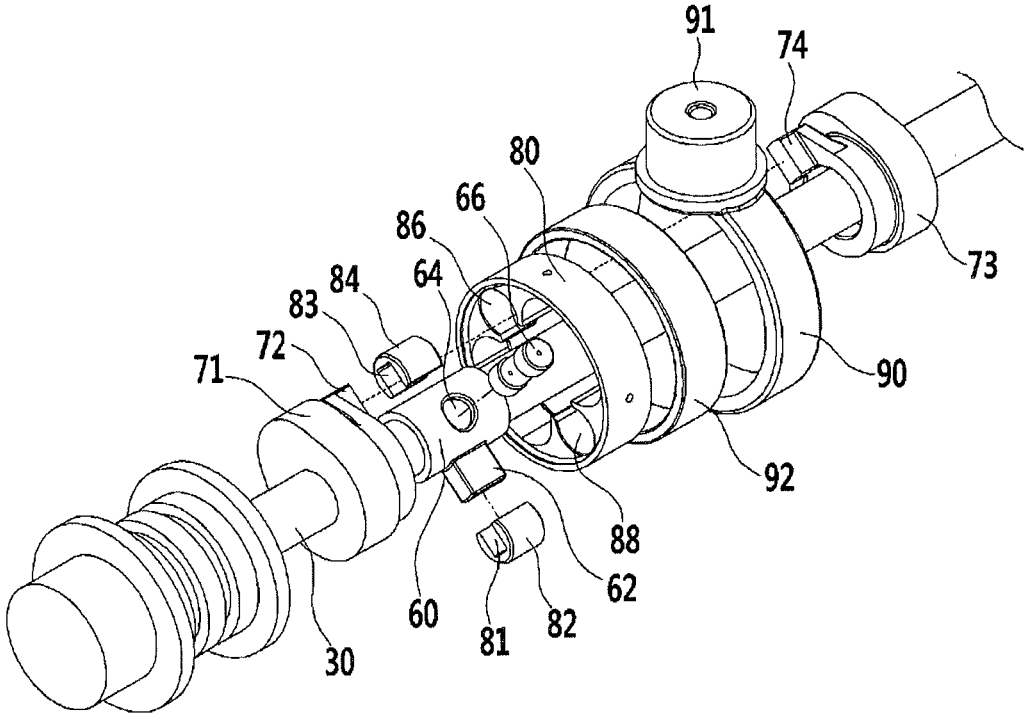
FIG. 5 is a partial exploded perspective view of a continuous variable valve duration apparatus according to an exemplary embodiment of the present invention.
Figure 6:
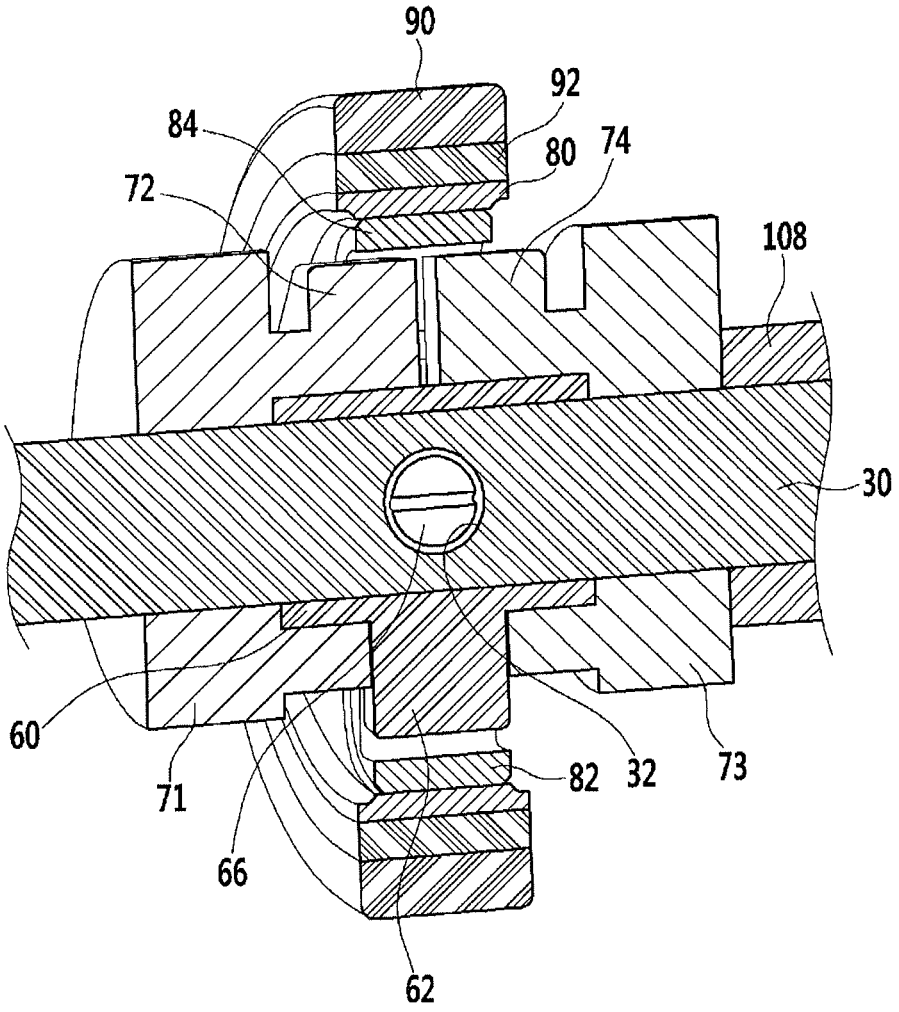
FIG. 6 is a partial cross-sectional view along line VI-VI of FIG. 4.

FIG. 4 is a partial perspective view of a continuous variable valve duration apparatus according to an exemplary embodiment of the present invention, FIG. 5 is a partial exploded perspective view of a continuous variable valve duration apparatus according to an exemplary embodiment of the present invention and FIG. 6 is a partial cross-sectional view along line VI-VI of FIG. 4.

Referring to FIG. 1 to FIG. 6, an engine according to an exemplary embodiment of the present invention includes an engine block 1, a cylinder head 10 mounted on the engine block 1 and a continuous variable valve duration apparatus mounted to the cylinder head 10.

In the drawings, the engine includes 4 cylinders 211, 212, 213 and 214, but is not limited thereto.

The continuously variable valve duration apparatus includes a camshaft 30, a plurality of first cams 71 and second cams 73 of which a cam key 72 and 74 is formed respectively thereto, and of which relative phase angles with respect to the camshaft 30 are variable, a plurality of rotation rings 60 mounted to the camshaft 30 and of which a ring key 62 is formed thereto respectively, a plurality of inner brackets 80 transmitting rotation of the camshaft 30 to the cam keys 72 and 74 of the first cams 71 and the seconds 73 respectively, a plurality of slider housings 90 of which each inner bracket 80 is rotatable inserted therein, a support bracket 96 connecting the slider housings 90 and a control portion 100 selectively moving the support bracket 96 and moving positions of the slider housings 90 so as to change rotation centers of the inner brackets 80.

The camshaft 30 may be an intake camshaft or an exhaust camshaft.

In the drawings, the first and second cam 71 and 73 is disposed to open valves 200 as a pair, but is not limited thereto.

The continuous variable valve duration apparatus further includes first pins 82 of which a ring key slot 81, the each ring key 62 is slidably inserted thereto, is formed thereto respectively and second pins 84 of which a cam key slot 83, the each the cam key 72 and 74 is slidably inserted thereto, is formed thereto respectively. And a first sliding pin hole 86 and a second sliding pin hole 88, of which the first pin 82 and the second pin 84 are inserted thereto respectively are formed to the inner bracket 80.

A camshaft hole 32 and a rotation ring hole 64 is formed to the camshaft 30 and the rotation ring 62 respectively and a connecting pin 66 is inserted into the camshaft hole 32 and the rotation ring hole 64 for connecting the camshaft 30 and the rotation rings 62.

The first pin 82 and the second pin 84 are formed as a circular cylinder shape and the first sliding pin hole 86 and the second sliding pin hole 88 are formed for the first pin 82 and the second pin 84 to be rotated within thereto. Since the first pin 82, the second pin 84, the first sliding pin hole 86 and the second sliding pin hole 88 are formed as a circular cylinder, thus wear resistance may be enhanced.

Also, productivity may be increased due to simple shapes of the first pin 82, the second pin 84, the first sliding pin hole 86 and the second sliding pin hole 88.

Parts of the first sliding pin hole 86 and the second sliding pin hole 88 are opened for movements of the ring key 62 and the cam keys 72 and 74 not to be interrupted.

A bearing 92 is inserted between the slider housing 90 and the inner bracket 80. Thus, rotation of the inner bracket 80 may be easily performed. In the drawings, the bearing 92 is depicted as a needle bearing, however it is not limited thereto. On the contrary, various bearings such as a ball bearing, a roller bearing and so on may be applied thereto.

The continuous variable valve duration apparatus further includes a guider 94 mounted to the cylinder head 10 and of which a guide hole 95 is formed thereto, a guide protrusion 91 is formed to the slider housing 90, the guide protrusion 91 is inserted into the guide hole 95 and the guide hole 95 guides movements of the guide protrusion 91. Thus, the slider housing 90 may move stably.

The control portion 100 include a ball screw 104 engaged with the support bracket 96 and a control motor 106 selectively rotating the ball screw 104. A screw bearing 98 is mounted to the support bracket 96 for rotatably supporting the ball screw 104.

A spacer 108 is disposed to the camshaft 30 for maintaining distances between one cylinder and neighboring cylinder. The spacer 108 may fix positions of the cams 71 and 73 so as to prevent the cams 71 and 73 from being separated from the inner bracket 80.

According to rotation of the control motor 106, positions of the slider housings 90 and the inner brackets 80 are changed and relative positions of rotation centers of the inner bracket 80 with respect to a position of a rotation center of the camshaft 30 are changed.

In an exemplary embodiment of the present invention, since rotation of one rotation ring 60 may be transmitted to the first and the second cam 71 and 73 simultaneously, thus numbers of elements may be reduced and durability may be improved.

As shown FIG. 3 and in FIG. 5, for example, an engine with the first, second, third and fourth cylinders 211, 212, 213 and 214 may vary durations of each cam 71 and 73 with four rotation rings 60, four inner brackets 80, four slider housings 90 and one control motor 106. Thus numbers of elements may be reduced, durability may be improved and operation stability may be secured.

Figure 7:
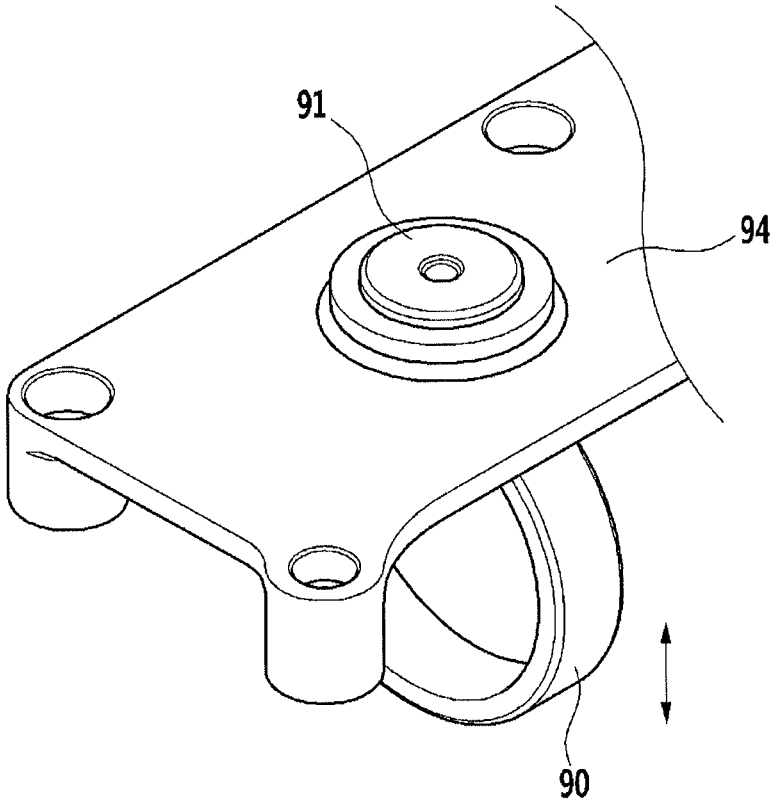
FIG. 7 is a drawing showing movements of a slider housing applied to a continuous variable valve duration apparatus according to an exemplary embodiment of the present invention.
Figure 8:
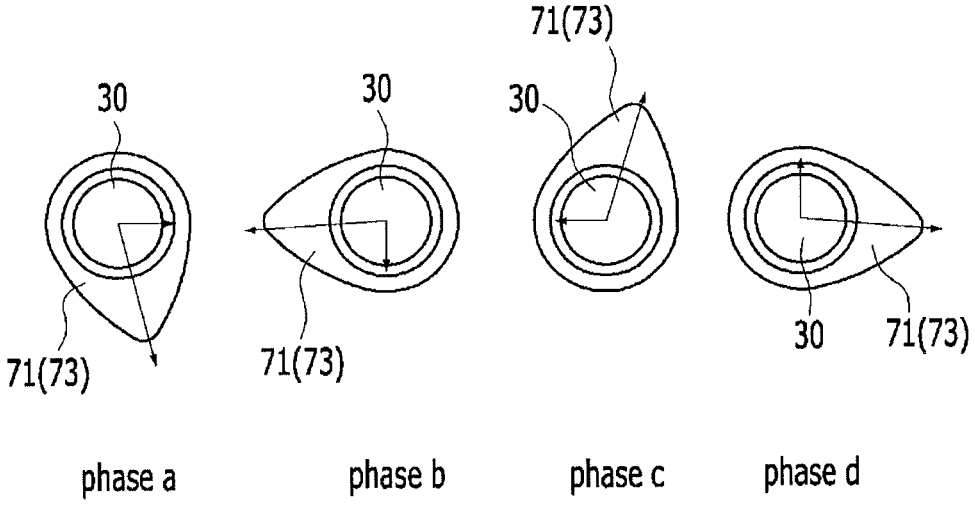
FIG. 8 and FIG. 9 are drawings showing mechanical motions of cams of a continuous variable valve duration apparatus according to an exemplary embodiment of the present invention.
Figure 9:
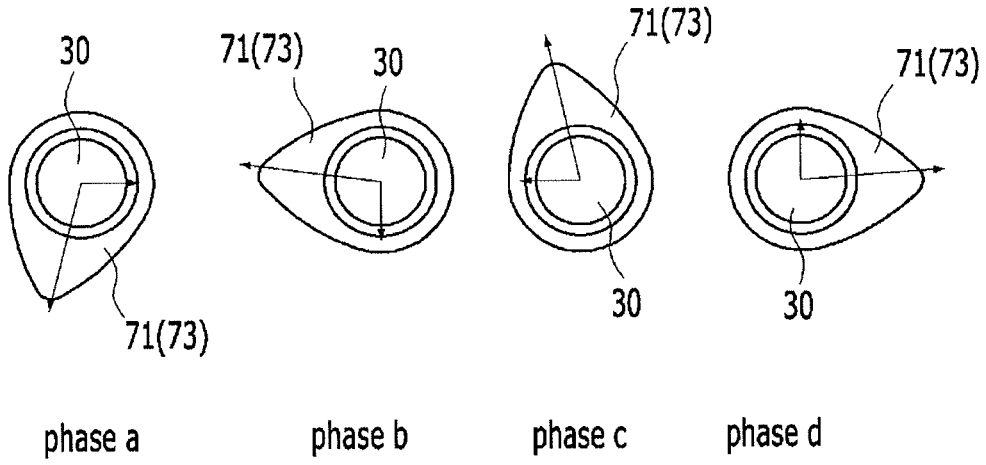

FIG. 7 is a drawing showing movements of a slider housing applied to a continuous variable valve duration apparatus according to an exemplary embodiment of the present invention, and FIG. 8 and FIG. 9 are drawings showing mechanical motions of cams of a continuous variable valve duration apparatus according to an exemplary embodiment of the present invention.

According to engine operation states, the ECU transmits control signals to the motor 106 of the control portion 100 to change the relative position of the slider housing 90.

In the exemplary embodiment of the present invention, the positions of the slider housing 90 with respect to the camshaft 30 are changed up and down directions.

When the slider housing 90 moves upward for example, as shown in FIG. 8 the rotation speed of the cams 71 and 73 is relatively faster than rotation speed of the camshaft 30 from phase a to phase b and from phase b to phase c, then the rotation speed of the cams 71 and 73 is relatively slower than rotation speed of the camshaft 30 from phase c to phase d and from phase d to phase a. That is, the valve duration is changed.

When the slider housing 90 moves downward for example, as shown in FIG. 9, the rotation speed of the cams 71 and 73 is relatively slower than rotation speed of the camshaft 30 from phase a to phase b and from phase b to phase c, then the rotation speed of the cams 71 and 73 is relatively faster than rotation speed of the camshaft 30 from phase c to phase d and from phase d to phase a. That is, the valve duration is changed.

While the rotation ring 60 is rotated together with the camshaft 30, the ring key 62 is slidable within the ring key slot 81, the first pin 82 and the second pin 84 are rotatable within the first sliding pin hole 86 and the second sliding pin hole 88 respectively and the cam keys 72 and 74 are slidable within the cam key slot 83. Thus, when the relative rotation centers of the inner brackets 80 and the camshaft 30 are changed, the relative rotation speed of the cams 71 and 73 with respect to the rotation speed of the camshaft 30 is changed.

Figure 10:
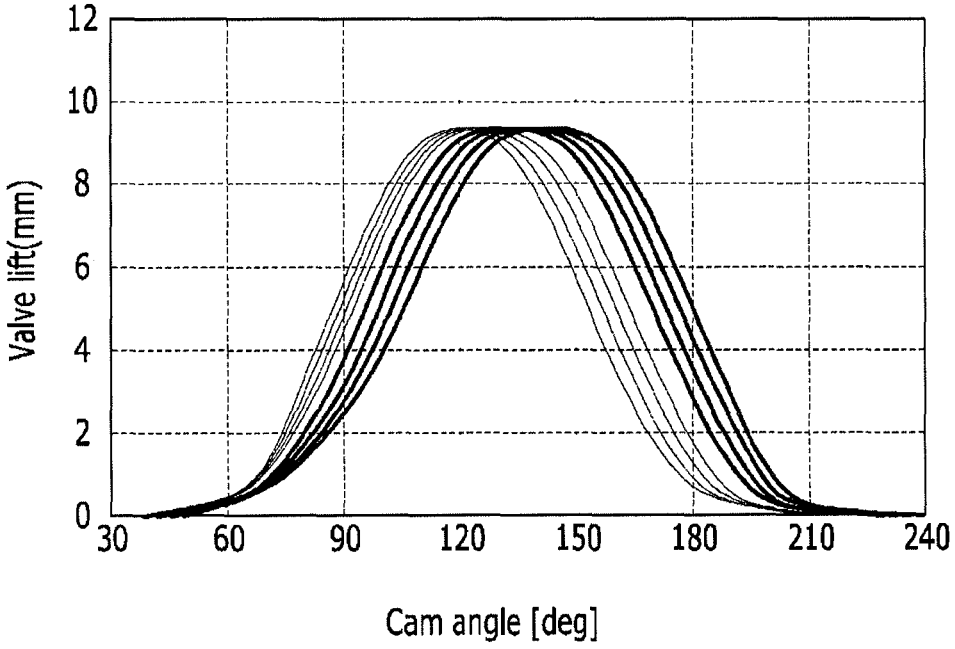
FIG. 10 is a graph of a valve profile of a continuous variable valve duration apparatus according to an exemplary embodiment of the present invention.

FIG. 10 is a graph of a valve profile of a continuous variable valve duration apparatus according to an exemplary embodiment of the present invention.

As shown in FIG. 10, although maximum lift of the valve 200 is constant, however rotation speed of the cam 71 and 73 with respect to the rotation speed of the camshaft 30 is changed according to relative positions of the slider housings 90 so that closing and opening time of the valve 200 is changed. That is, duration of the valve 200 is changed.

While opening time of the valve 200 is constant, closing time of the valve 200 is changed in FIG. 9, it is not limited thereto. According to various mounting angle of the cams 71 and 73 and the valve 200, various contacting angles between cam lobe of the cams 71 and 73 and the valve 200 and so on, various valve duration may be performed. That is, according to contacting positions of the valve 200 and the cams 71 and 73, closing timing of the valve 200 may be constant, opening timing and closing timing of the valve 200 may be changed simultaneously, or the continuous variable valve duration apparatus may be operated as a continuously variable valve timing apparatus.

As described above, a continuous variable valve duration apparatus according to an exemplary embodiment of the present invention may vary an opening duration of a valve according to operation conditions of an engine, with a simple construction.

The continuous variable valve duration apparatus according to an exemplary embodiment of the present invention may be reduced in size and thus the entire height of a valve train may be reduced.

Since the continuous variable valve duration apparatus may be applied to an existing engine without excessive modification, thus productivity may be enhance and production cost may be reduced.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A valve duration control apparatus comprising:

a camshaft;

a plurality of first cams and a plurality of second cams of which a cam key is formed respectively thereto, and of which relative phase angles with respect to the camshaft are variable;

a plurality of rotation rings mounted to the camshaft and of which a ring key is formed thereto respectively, a plurality of inner brackets transmitting rotation of the camshaft to the cam keys of the first cams and the second cams, respectively;

a plurality of slider housings of which each inner bracket is rotatable inserted therein;

a support bracket connecting the plurality of slider housings; and a control portion moving the support bracket and moving positions of the plurality of slider housings to change rotation centers of the plurality of inner brackets.

2. The valve duration control apparatus of claim 1, further comprising:

a first pin of which a ring key slot where the ring key is slidably inserted thereto is formed thereto; and a second pin of which a cam key slot where the cam key is slidably inserted thereto is formed thereto; and wherein a first sliding pin hole and a second sliding pin hole where the first pin and the second pin are inserted thereto respectively are formed to the plurality of inner brackets respectively.

3. The valve duration control apparatus of claim 2, wherein the first pin and the second pin are formed as a circular cylinder shape; and the first sliding pin hole and the second sliding pin hole are formed for the first pin and the second pin to be rotated within thereto.

4. The valve duration control apparatus of claim 3, wherein parts of the first sliding pin hole and the second sliding pin hole are open so that the ring key and the cam key are movable through the open parts of the first sliding pin hole and the second sliding pin hole, respectively.

5. The valve duration control apparatus of claim 1, further comprising a bearing inserted between each slider housing and each inner bracket.

6. The valve duration control apparatus of claim 1, further comprising a guider including a guide hole, wherein a guide protrusion is formed to each slider housing, the guide protrusion is inserted into the guide hole, and the guide hole guides movements of the guide protrusion.

7. The valve duration control apparatus of claim 1, wherein the control portion comprises:

a ball screw engaged with the support bracket; and a control motor rotating the ball screw.

8. The a valve duration control apparatus of claim 7, further comprising a screw bearing mounted to the support bracket for rotatably supporting the ball screw.

9. The valve duration control apparatus of claim 1, wherein the camshaft and the rotation ring are connected through a connecting pin.

10. The valve duration control apparatus of claim 1, further comprising a spacer disposed to the camshaft and configured for maintaining distances between one cylinder and a neighboring cylinder.

11. An engine comprising:

a camshaft;

a plurality of first cams and a plurality of second cams of which a cam key is formed respectively thereto, of which relative phase angles with respect to the camshaft are variable, and disposed on a corresponding cylinder of the engine, respectively;

a plurality of rotation rings mounted to the camshaft, of which a ring key is formed thereto respectively, and disposed on the corresponding cylinder respectively, a plurality of inner brackets transmitting rotation of the camshaft to the cam keys of the first cams and the second cams, respectively, a plurality of slider housings of which each inner bracket is rotatable inserted therein;

a support bracket connecting the plurality of slider housings; and a control portion moving the support bracket and moving positions of the plurality of slider housings to change rotation centers of the plurality of inner brackets.

12. The engine of claim 11, further comprising:

a first pin of which a ring key slot where the ring key is slidably inserted thereto is formed thereto; and a second pin of which a cam key slot where the cam key is slidably inserted thereto is formed thereto; and wherein a first sliding pin hole and a second sliding pin hole where the first pin and the second pin are inserted thereto respectively are formed to the plurality of inner brackets respectively.

13. The engine of claim 12, wherein the first pin and the second pin are formed as a circular cylinder shape; and the first sliding pin hole and the second sliding pin hole are formed for the first pin and the second pin to be rotated within thereto.

14. The engine of claim 13, wherein parts of the first sliding pin hole and the second sliding pin hole are open so that the ring key and the cam key are movable through the open parts of the first sliding pin hole and the second sliding pin hole, respectively.

15. The engine of claim 11, further comprising a bearing inserted between each slider housing and each inner bracket.

16. The engine of claim 11, further comprising a guider including a guide hole, wherein a guide protrusion is formed to each slider housing, the guide protrusion is inserted into the guide hole, and the guide hole guides movements of the guide protrusion.

17. The engine of claim 11, wherein the control portion comprises:

a ball screw engaged with the support bracket; and a control motor rotating the ball screw.

18. The engine of claim 17, further comprising a screw bearing mounted to the support bracket for rotatably supporting the ball screw.

19. The engine of claim 11, wherein the camshaft and the rotation ring are connected through a connecting pin.

20. The engine of claim 11, further comprising a spacer disposed to the camshaft and configured for maintaining distances between one cylinder and a neighboring cylinder of the engine.

* * * * *